US012669022B1

(12) United States Patent
Ghamdi et al.

(10) Patent No.: US 12,669,022 B1
(45) Date of Patent: Jun. 30, 2026

(54) CIRCULATION SUB WITH INTEGRATED FLAPPER CHECK VALVE

(71) Applicant: SAUDI ARABIAN OIL COMPANY, Dhahran (SA)

(72) Inventors: Ibrahim A. Ghamdi, Dhahran (SA); Abdulaziz Khalaf S. Alanazi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/062,496

(22) Filed: Feb. 25, 2025

(51) Int. Cl.
*E21B 21/00* (2006.01)
*E21B 21/10* (2006.01)
*E21B 34/14* (2006.01)

(52) U.S. Cl.
CPC ..... *E21B 21/003* (2013.01); *E21B 21/103* (2013.01); *E21B 34/142* (2020.05); *E21B 2200/05* (2020.05)

(58) Field of Classification Search
CPC .... E21B 21/003; E21B 21/103; E21B 34/142; E21B 2200/05
See application file for complete search history.

(56) References Cited

U.S. PATENT DOCUMENTS 3,013,612 A * 12/1961 Angel ..... E21B 21/10 137/512.1
3,220,481 A * 11/1965 Park ..... E21B 21/10 166/325
4,554,981 A * 11/1985 Davies ..... E21B 43/116 175/4.54
4,889,199 A * 12/1989 Lee ..... E21B 34/142 175/317
2009/0266659 A1* 10/2009 Lembcke ..... F16F 9/3235 188/268

* cited by examiner

*Primary Examiner* — James G Sayre
(74) *Attorney, Agent, or Firm* — Vorys, Sater, Seymour and Pease LLP

(57) ABSTRACT

A circulation sub includes a cylindrical body defining an internal flowpath extending longitudinally therethrough and being couplable within a drillstring, a projectile seat piston included within the cylindrical body and longitudinally translatable within the circulation sub, one or more bypass ports defined in the cylindrical body to facilitate fluid communication between the internal flowpath and an external environment of the circulation, wherein the projectile seat piston is longitudinally translatable to selectively occlude or expose the one or more bypass ports, and a flapper check valve pivotably mounted within the cylindrical body and operable to seal the internal flowpath at a longitudinal location between the one or more bypass ports and an uphole end of the cylindrical body in response to a backflow into the circulation sub.

20 Claims, 4 Drawing Sheets

CIRCULATION SUB WITH INTEGRATED FLAPPER CHECK VALVE

FIELD OF THE DISCLOSURE

The present disclosure relates generally to flow control in wellbores, and, more particularly, to maintaining flow control in wellbores in which circulation subs are deployed.

BACKGROUND OF THE DISCLOSURE

Circulation subs, such as PBL® subs, are commonly installed within a drillstring at or near a bottom hole assembly (BHA) to control the flow of drilling fluid between the interior of the drill string and an annulus surrounding the drillstring. During a standard drilling operation, drilling fluid may flow through the circulation sub and into the BHA. As needed, the circulation sub may be actuated to divert further flow from the BHA to the annulus through one or more bypass ports. For example, an operator may wish to flow heavy lost circulation materials (LCMs) directly into the annulus for plugging lost circulation zones rather than flowing the LCMs through the BHA where the LCMs could plug or damage sensitive equipment. In further examples, the circulation sub may be used to redirect wellbore cleaning fluids or any other desired fluid flow from the drillstring to the annulus. Accordingly, the circulation sub may safeguard against damage during drilling operations and may perform other applications as well.

To reestablish fluid flow through the BHA, the bypass ports of some circulation subs may be plugged with locking projectiles flowed or otherwise conveyed through the drillstring to cease flow through the bypass ports. The use of these locking projectiles, however, has historically resulted in instances where the locking projectiles have failed to completely plug the bypass ports, leaving the circulation sub open to the annulus. In the event of a kick or flow from the formation into the annulus, a backflow may enter the circulation sub through the open bypass ports and may flow upward through the drillstring towards the surface. This high-pressure backflow can create dangerous conditions at the surface. In current practice, spring-type float valves may be installed below the circulation sub to prevent backflow below the circulation sub, but the presence of the open bypass ports above the float valve enables dangerous backflow through the drillstring.

As such, tools and methods for enabling flow redirection in a drillstring while further preventing backflow therethrough are desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

In an embodiment consistent with the present disclosure, a circulation sub includes a generally cylindrical body defining an internal flowpath longitudinally therethrough and couplable within a drillstring, a projectile seat piston included at a downhole end of the generally cylindrical body and longitudinally translatable within the circulation sub, one or more bypass ports selectively isolatable via the projectile seat piston and operable to enable fluid communication between the internal flowpath and an external environment of the circulation sub, and a flapper check valve supported in the generally cylindrical body, the flapper check valve operable to seal the flowpath at a longitudinal location between the one or more bypass ports and an uphole end of the cylindrical body in response to a backflow into the circulation sub.

In another embodiment, a method of controlling flow through a circulation sub includes providing an internal flowpath for a fluid through a drillstring including circulation sub coupled therein. The circulation sub includes a generally cylindrical body defining an uphole end and a downhole end, a projectile seat piston within the generally cylindrical body, one or more bypass ports extending radially through the generally cylindrical body, a valve seal disposed between the bypass ports and the upper end of the generally cylindrical body, and a flapper engageable with the valve seal. The method further includes releasing an activation projectile through the drillstring and into the circulation sub, preventing flow through the projectile seat piston with the activation projectile generating a seal with a projectile seat, exposing the one or more bypass ports via translation of the projectile seat piston to enable fluid communication between an internal flowpath of the circulation sub and an external environment, seating the flapper against the valve seal in response to a backflow entering the circulation sub through the bypass ports to thereby prevent backflow into the drillstring uphole of the circulation sub Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
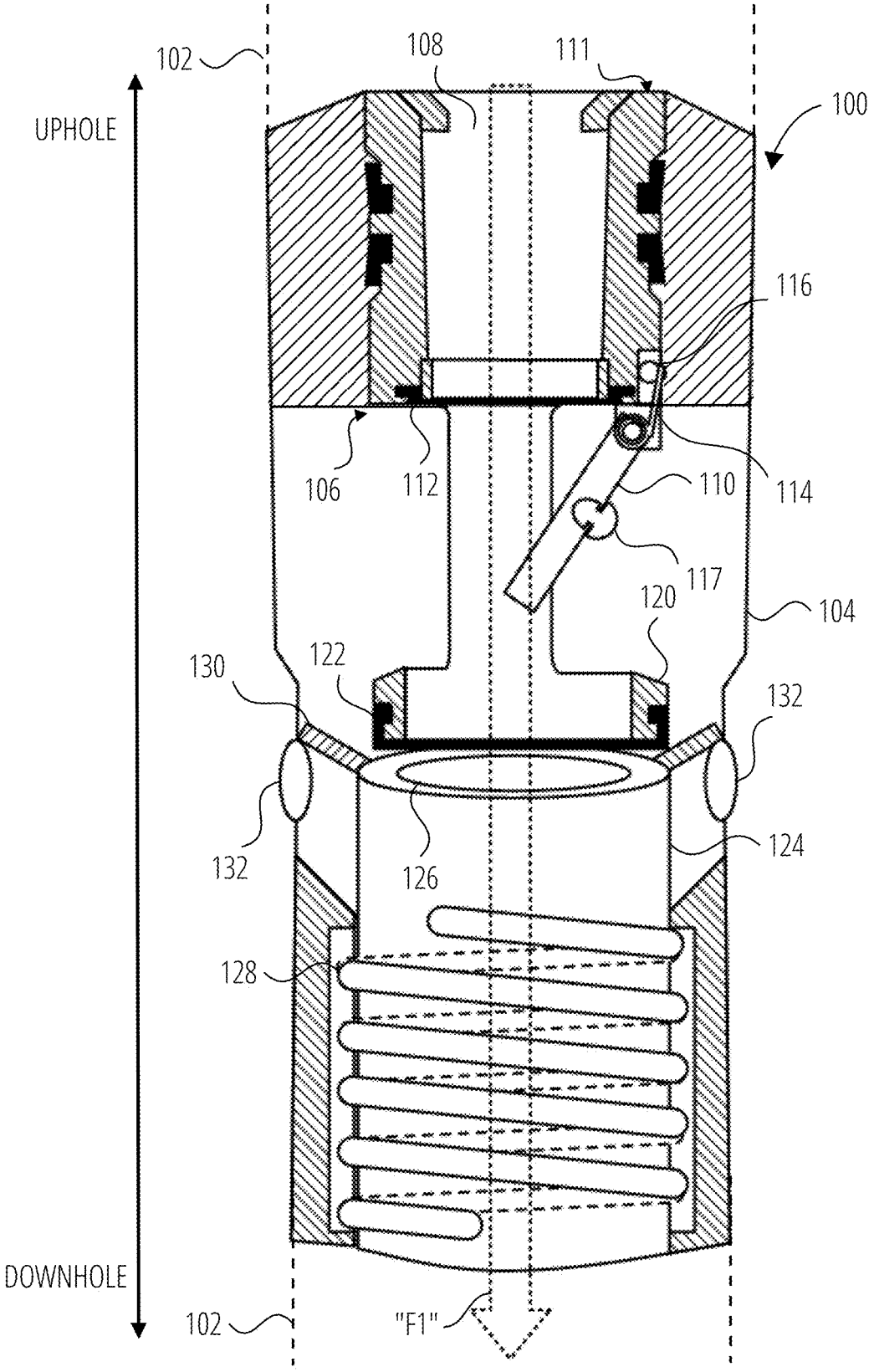
FIG. 1 is a schematic sectional side view of a circulation sub installed within a drillstring, according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to maintaining well control within wellbores in which circulation subs are deployed in a drillstring. Embodiments disclosed herein include tools and methods operable to enable circulation of fluids both longitudinally through a circulation sub and radially into an external environment (annulus) around the circulation sub, while further providing protection against backflow through the drillstring. The disclosed methods and tools may incorporate a flapper check valve at an uphole end of the circulation sub which may seal the circulation sub upon a backflow entering the circulation sub via one or more bypass ports. The disclosed embodiments may enable the circulation sub to provide fluid to a BHA during normal operation, discharge LCMs or other fluids through one or more bypass ports as needed, and prevent backflow through the drillstring to maintain well control.

FIG. 1 is a schematic sectional side view of a circulation sub 100 installed within a drillstring 102, according to one or more embodiments of the present disclosure. The drillstring 102 may be inserted (extended) within a wellbore (not shown) during drilling operations, such that a bottom hole assembly (BHA) may be carried downhole from the circulation sub 100 on the drillstring 102. The circulation sub 100 may comprise a generally cylindrical body 104 which may be coupled within the drillstring 102 as a component thereof.

The cylindrical body 104 may support a flapper check valve 106 at an uphole end thereof. The flapper check valve 106 may provide a portion of a longitudinal internal flowpath 108 through the circulation sub 100. The flapper check valve 106 may receive fluid flow "F1" from the drillstring 102 above and into the circulation sub 100. The flapper check valve 106 may include a flapper 110 pivotable against a downhole end of a valve body 111. The flapper 110 may be sized to be received against a valve seal 112 at a downhole end of the valve body 111 (see FIG. 3) to generate a fluid seal across the flow path 108.

In some embodiments, the flapper 110 may be biased towards the valve scal 112 via a torsion spring 114 mated to the flapper 110. In the illustrated embodiment, the torsion spring 114 is further mated to a bumper 116 on an end of the torsion spring 114 opposing the flapper 110, which may provide a point of contact against the valve body 111 to hold the torsion spring 114 in place. The bumper 116 may further control a speed of the flapper 110 during motion (activation) to prevent fluid hammering within the flapper check valve 106. In some embodiments, a flapper bumper 117 may be provided on the flapper 110 to act as a stopper for the flapper 110 in a closed configuration and to dampen impacts that may damage the flapper 110.

A cage 120 may project downhole from the valve body 111, which may continue the internal flowpath 108 of the circulation sub 100. The cage 120 provides a shock absorber 122 operable to limit travel speed of any wellbore projectiles to prevent damage to the circulation sub 100, as well as sudden impact, water hammer and prolong the check valve life.

Further downhole from the cage 120, a projectile seat piston 124 may be included at a downhole end of the cylindrical body 104 of the circulation sub 100. The projectile seat piston 124 may be longitudinally translatable within the cylindrical body 104, and may define a projectile seat 126 at an uphole end thereof. The projectile seat 126 may define an aperture sized to receive a wellbore projectile (e.g., activation projectile 202 of FIG. 2) to actuate the circulation sub 100, while allowing flow therethrough prior to seating of a projectile thereon. The projectile seat piston 124 may be mated to a compression spring 128 operable to bias the projectile seat piston 124 uphole within the circulation sub 100 until receiving a wellbore projectile.

In some embodiments, the projectile seat piston 124 may include an extended lip 130 angularly projecting from the projectile seat 126 and towards an interior wall of the cylindrical body 104. The extended lip 130 may be tapered to guide wellbore projectiles and fluid flow "F1" towards the projectile seat 126 and the aperture therein during normal operation. During normal operation, the extended lip 130 may isolate or otherwise block one or more bypass port 132 defined through the interior wall of the circulation sub 100. The bypass port 132 may provide fluid communication between the internal flow path 108 and an external environment (e.g., an annulus) around the circulation sub 100 and drillstring 102. When the projectile seat piston 124 is extended uphole, as shown in FIG. 1, the extended lip 130 may occlude the bypass ports 132 and thereby prevent this fluid communication and any flow through the bypass ports 132.

Figure 2:
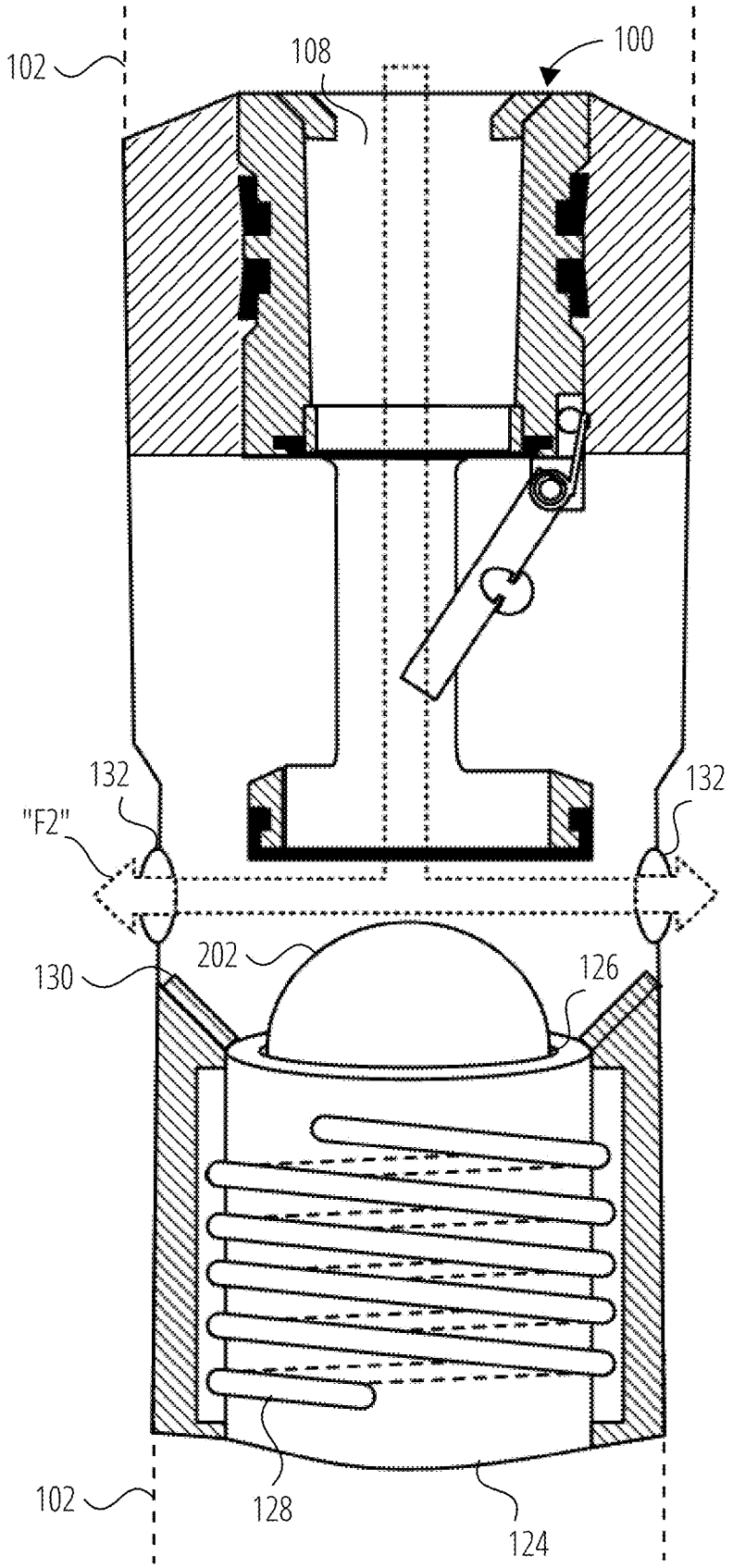
FIG. 2 is a schematic sectional side view of the circulation sub with an activation projectile seated therein to enable bypass flow, according to one or more embodiments of the present disclosure.

FIG. 2 is a schematic sectional side view of the circulation sub 100 with an activation projectile 202 seated therein to enable bypass flow, according to one or more embodiments of the present disclosure. In the illustrated embodiment, the activation projectile 202 has been pumped or dropped downhole through the drillstring 102 and has been seated within the projectile seat 126 of the projectile seat piston 124. The activation projectile 202 may be a ball or dart designed to travel through the drillstring 102 to the circulation sub 100, and may be sized to interact specifically with the projectile seat piston 124 in operation. In some embodiments, the activation projectile 202 may be introduced when circulation is lost within the external environment around the circulation sub 100 (e.g., when the drillstring 102 encounters a geologic zone in which an unsatisfactory amount of drilling fluid enters the formation rather than being returned to the surface), such that the bypass ports 132 of the circulation sub 100 may be exposed.

In some embodiments, the seating of the activation projectile 202 against the projectile seat 126 may seal the aperture of the projectile seat piston 124 to prevent further flow through the flowpath 108 below the activation projectile 202. As flow is blocked within the circulation sub 100, further pumping of fluids into the drillstring 102 and circulation sub 100 may increase pressure within the circulation sub 100. Accordingly, the force of the fluid pressure may act upon the extended lip 130 and activation projectile 202 to push against the projectile seat piston 124. The force may increase until a spring force of the compression spring 128 is overcome and the compression spring 128 begins to compress, thus allowing translation of the projectile seat piston 124 towards a downhole end of the circulation sub 100.

The translation of the projectile seat piston 124 will correspondingly translate the extended lip 130 below (downhole of) the location of the bypass ports 132 within the interior surface of the circulation sub 100, thereby exposing the bypass ports 132. As the bypass ports 132 are exposed to the internal flowpath 108 of the circulation sub 100, the fluid flow "F2" may begin flow out through the bypass ports 132 and into the external environment around the circulation sub 100 and drillstring 102. In some embodiments, the external environment may be a wellbore exhibiting a loss of circulation as described above. In these embodiments, the fluid flow "F2" may incorporate a blocking fluid that includes heavy LCMs that may include polymers, gels, cellulose, or other blocking agents operable to plug lost circulation zones in the external environment. Thus, the fluid flow "F2" may continue to be expelled through the bypass ports 132 until circulation is restored within the external environment.

Figure 3:
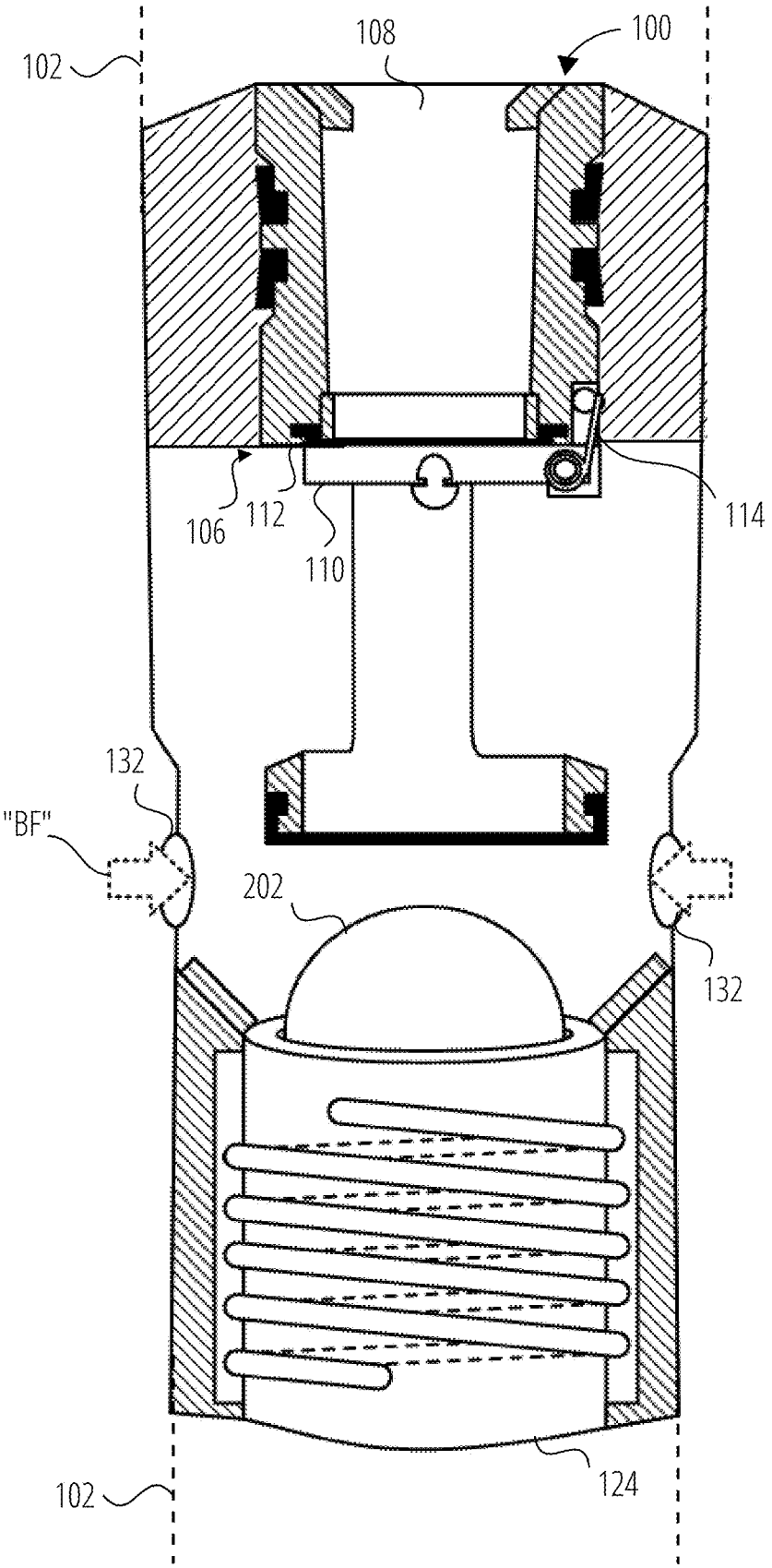
FIG. 3 is a schematic sectional side view of the circulation sub with a flapper check valve that is closed by back flow within the circulation sub, according to one or more embodiments of the present disclosure.

FIG. 3 is a schematic sectional side view of the circulation sub 100 with a closed flapper check valve 106 following back flow within the circulation sub 100, according to one or more embodiments of the present disclosure. As discussed above, the translation of the projectile seat piston 124 may enable fluid communication between the internal flowpath 108 of the circulation sub 100 and an external environment around the circulation sub 100 and the drillstring 102. However, any kicks or increased production within the external environment may lead to greater fluid pressure in the external environment than the fluid pressure within the circulation sub 100. In some embodiments, further projectiles (not shown) may be introduced to the circulation sub 100 to clear the activation projectile 202 and re-isolate the bypass ports 132. However, in some cases the further projectiles may fail to clear the activation projectile 202 and the bypass ports 132 may maintain fluid communication between the circulation sub 100 and the external environment. Accordingly, a backflow "BF" may occur within the circulation sub 100 as fluid from the external environment enters the circulation sub 100 and travels towards the uphole end.

As the backflow "BF" enters the circulation sub 100 through the bypass ports 132, the force of the fluid pressure may act against the flapper 110, adding to the spring force of the torsion spring 114 biasing the flapper 110 towards a closed position. The combined force of the backflow "BF" and the torsion spring 114 may cause the flapper 110 to pivot closed and seal against the valve seal 112. Seating the flapper 110 against the valve seal 112 may prevent the backflow "BF" from travelling uphole through the flapper check valve 106 and into the drillstring 102. As such, the flapper check valve 106 may prevent dangerous conditions within and above the drillstring 102, thus maintaining proper well control during a drilling process.

Figure 4:
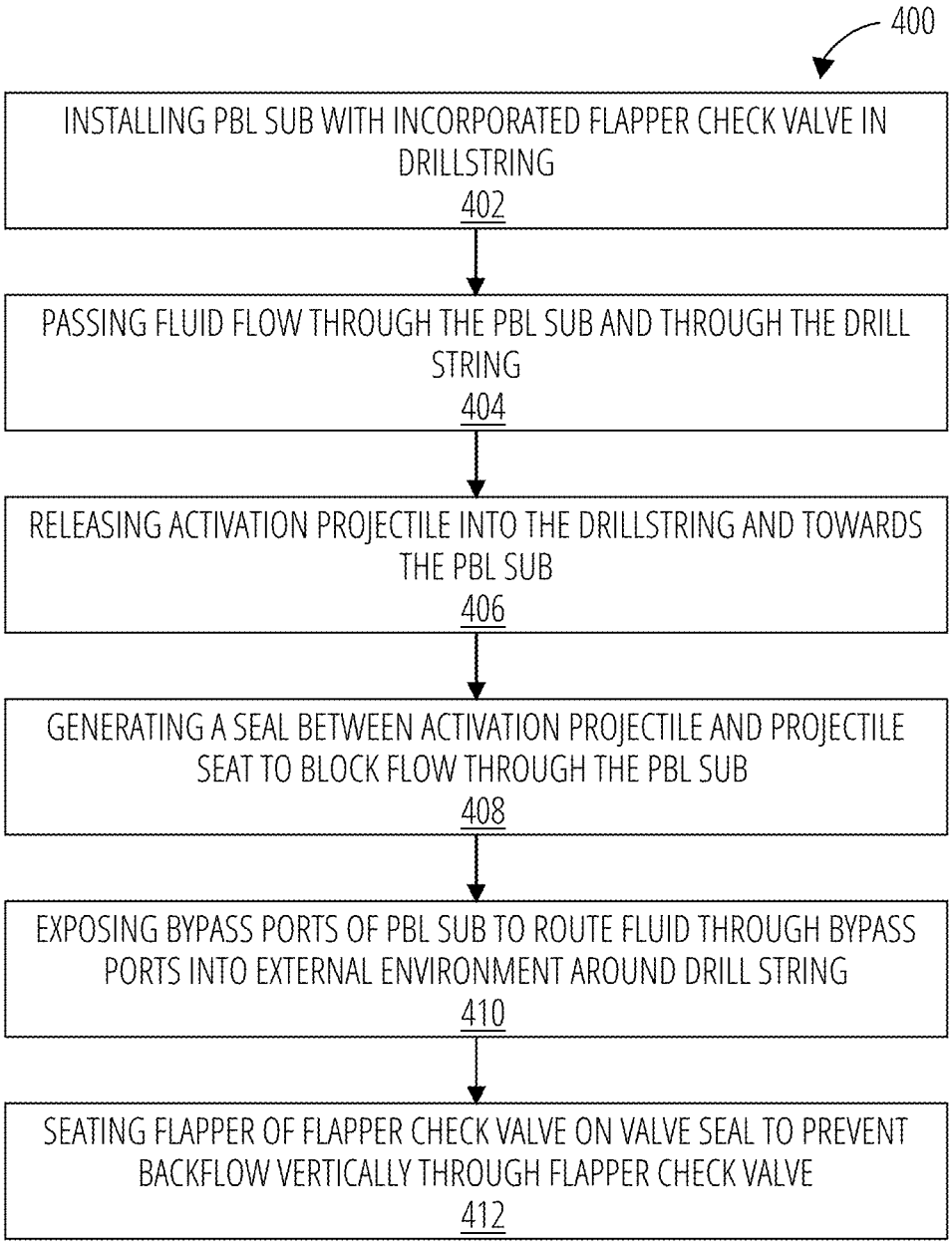
FIG. 4 is a flowchart illustrating an example method for controlling flow through a circulation sub, according to one or more embodiments of the present disclosure.

In view of the structural and functional features described above, example methods will be better appreciated with reference to FIG. 4. While, for purposes of simplicity of explanation, the example methods of FIG. 4 are shown and described as executing serially, it is to be understood and appreciated that the present examples are not limited by the illustrated order, as some actions could in other examples occur in different orders, multiple times and/or concurrently from that shown and described herein. Moreover, it is not necessary that all described actions be performed to implement the methods, and conversely, some actions may be performed that are omitted from the description.

FIG. 4 is a flowchart illustrating an example method 400 for controlling flow through a circulation sub, according to one or more embodiments of the present disclosure. The method 400 may be implemented by the circulation sub 100 of FIG. 1, as shown in FIGS. 1-3. Thus, reference may be made to the example of FIGS. 1-3 in the example method 400 of FIG. 4. The method 400 may begin at 402 with installing a circulation sub (e.g., the circulation sub 100) with an incorporated flapper check valve (e.g., the flapper check valve 106) within a drillstring (e.g., the drillstring 102). The circulation sub and flapper check valve may be installed above a BHA of the drillstring to enable circulation corrections during drilling and to provide well control as needed. The method 400 may continue at 404 with providing an internal flowpath (e.g., the internal flowpath 108) longitudinally through the circulation sub and flapper check valve, which may enable a fluid to flow through the flapper check valve and circulation sub into the drillstring and BHA below. As such, the flow of fluids at 402 may continue until a loss of circulation is detected in an external environment around the circulation sub and/or drillstring.

The method 400 may continue at 406 with releasing an activation projectile (e.g., the activation projectile 202) into the drillstring, which may travel through the drillstring and into the circulation sub. The activation projectile may be released into the drillstring in response to the detected loss of circulation within the external environment around the drillstring and circulation sub, such that the circulation sub may be activated in an effort to restore circulation. As such, the method 400 may continue at 408 with preventing flow through a projectile seat piston (e.g., the projectile seat piston 124) of the circulation sub with the activation projectile. As the activation projectile travels into the circulation sub, the activation projectile may generate a seal against a projectile seat (e.g., the projectile seat 126) and an aperture defined therein. The activation projectile may accordingly prevent further fluid flow through the projectile seat piston and out of a downhole end of the circulation sub. As fluid continues to enter the circulation sub from uphole, pressure may build against the activation projectile and the projectile seat piston.

The method 400 may continue at 410 with exposing one or more bypass ports (e.g., the bypass ports 132) of the circulation sub to enable fluid communication between the circulation sub and the external environment. The bypass ports may be initially blocked or isolated from the internal flowpath of the circulation sub via an extended lip (e.g., the extended lip 130) of the projectile seat piston. As the pressure builds within the circulation sub, the force of the fluid pressure may overcome a spring force of a compression spring (e.g., the compression spring 128) holding the projectile seat piston in place. As the compression spring compresses and the projectile seat piston translates towards a downhole end of the circulation sub, the bypass ports 132 may be exposed to provide fluid communication between the circulation sub and the external environment. While the bypass ports 132 are exposed, a heavy fluid flow including LCMs may be pumped through the drillstring, into the circulation sub, and through the bypass ports. The LCMs may plug lost circulation zones to correct lost circulation within the external environment without exposing the BHA to the LCMs. However, if the bypass ports are exposed when a kick occurs within the external environment, a backflow may occur through the bypass ports and into the circulation sub.

The method 400 may thus continue at 412 with seating the flapper against a valve seal (e.g., the valve seal 112) of the flapper check valve to prevent the backflow from passing uphole through the flapper check valve. The force of the fluid pressure and the spring force of a torsion spring may (e.g., the torsion spring 114) bias the flapper towards a closed position and causes the flapper to pivot towards the flapper check valve. The flapper may generate a seal against the valve seal to thus prevent any fluid from entering the flapper check valve and traveling uphole through the mated drillstring. As such, the circulation sub and integrated flapper check valve may provide proper well control within the circulation sub while enabling circulation restoration as needed.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A circulation sub, comprising:

a cylindrical body defining an internal flowpath extending longitudinally therethrough and being couplable within a drillstring;

a projectile seat piston included within the cylindrical body and longitudinally translatable within the circulation sub;

one or more bypass ports defined radially through the cylindrical body to facilitate fluid communication between the internal flowpath and an external environment of the circulation sub, wherein the projectile seat piston is longitudinally translatable to selectively occlude or expose the one or more bypass ports; and a flapper check valve pivotably mounted within the cylindrical body and operable to fully seal the internal flowpath and prevent flow therethrough at a longitudinal location between the one or more bypass ports and an uphole end of the cylindrical body in response to a backflow into the circulation sub.

2. The circulation sub of claim 1, wherein the projectile seat piston is mated to a compression spring operable to compress when an activation projectile is seated against a projectile seat at an uphole end of the projectile seat piston.

3. The circulation sub of claim 1, wherein the projectile seat piston includes an extended lip protruding from an uphole end of a projectile seat, the extended lip being operable to occlude the one or more bypass ports prior to longitudinal translation of the projectile seat piston.

4. The circulation sub of claim 1, further comprising a torsion spring mated to the flapper and operable to urge the flapper towards a valve seal of the flapper check valve.

5. The circulation sub of claim 4, wherein the torsion spring is further mated to a bumper receivable against a valve body of the flapper check valve to control a speed of the flapper during motion to prevent fluid hammer within the flapper check valve.

6. The circulation sub of claim 4, further comprising a flapper bumper installed on the flapper to act as a stopper for the flapper in a closed configuration and to dampen impacts on the flapper.

7. The circulation sub of claim 1, further comprising a cage extending axially downward from a valve body of the flapper check valve, the cage including a shock absorber operable to limit travel speed of an activation projectile to prevent damage to the circulation sub.

8. The circulation sub of claim 1, further comprising a valve seal included at a downhole end of a valve body of the flapper check valve and engageable with a flapper of the flapper check valve to generate a fluid seal.

9. A method of controlling flow through a circulation sub, the method comprising:

flowing a fluid through a circulation sub arranged within a drillstring, the circulation sub including:

a cylindrical body defining an uphole end and a downhole end;

a projectile seat piston arranged within the cylindrical body;

one or more bypass ports defined in the cylindrical body;

a valve seal arranged between the one or more bypass ports and the uphole end of the cylindrical body; and a flapper pivotably mounted within the cylindrical body and engageable with the valve seal;

releasing an activation projectile through the drillstring and into the circulation sub;

receiving the activation projectile at a projectile seat of the projectile seat piston and thereby generating a seal that prevents flow through the projectile seat piston;

longitudinally translating the projectile seat piston within the cylindrical body and thereby exposing the one or more bypass ports to enable fluid communication between an internal flowpath of the circulation sub and an external environment; and seating the flapper against the valve seal in response to a backflow entering the circulation sub through the one or more bypass ports to thereby prevent backflow into the drillstring uphole of the circulation sub.

10. The method of claim 9, wherein longitudinally translating the projectile seat piston within the cylindrical body comprises increasing a pressure of a fluid flow within the internal flowpath against the activation projectile seated on the projectile seat, and thereby longitudinally translating the projectile seat piston towards the downhole end of the cylindrical body.

11. The method of claim 10, wherein receiving the activation projectile at the projectile seat piston is preceded by biasing the projectile seat piston towards the uphole end of the cylindrical body with a compression spring until acted upon by the pressure of the fluid flow.

12. The method of claim 9, further comprising limiting a travel speed of the flapper via a bumper mated to a torsion spring biasing the flapper towards the valve seal.

13. The method of claim 12, further comprising dampening impacts on the flapper via a flapper bumper installed on the flapper.

14. The method of claim 13, further comprising limiting a travel speed of the activation projectile via a shock absorber mounted to a cage of the flapper check valve to prevent damage to the circulation sub.

15. The method of claim 9, further comprising releasing a blocking fluid through the bypass ports and into the external environment around the circulation sub, the blocking fluid including lost circulation materials operable to seal any lost circulation zones.

16. The method of claim 9, further comprising:

releasing further projectiles through the drillstring and into the circulation sub; and clearing the activation projectile from the projectile seat via the further projectiles and longitudinally translating the projectile seat piston within the cylindrical body to re-isolate the bypass ports.

17. A system comprising:

a drillstring disposed within a wellbore; and a circulation sub, including:

a cylindrical body defining an internal flowpath extending longitudinally therethrough and coupled within the drillstring;

a projectile seat piston included within the cylindrical body and longitudinally translatable within the circulation sub;

one or more bypass ports defined radially through the cylindrical body to facilitate fluid communication between the internal flowpath and an external environment around the drillstring, wherein the projectile seat piston is longitudinally translatable to selectively occlude or expose the one or more bypass ports; and a flapper check valve pivotably mounted within the cylindrical body and operable to fully seal the internal flowpath and prevent flow therethrough at a longitudinal location between the one or more bypass ports and an uphole end of the cylindrical body in response to a backflow into the circulation sub and through the drillstring.

18. The system of claim 17, further comprising a compression spring mated to the projectile seat piston and an activation projectile releasable into the drillstring, wherein the activation projectile is seatable on the projectile seat to enable compression of the compression spring via fluid flow into the internal flowpath.

19. The system of claim 18, further comprising a cage extending axially downward from a valve body of the flapper check valve, the cage including a shock absorber operable to limit travel speed of the activation projectile to prevent damage to the circulation sub.

20. The system of claim 17, wherein the projectile seat piston includes an extended lip protruding from an uphole end of a projectile seat, the extended lip being operable to occlude the one or more bypass ports prior to longitudinal translation of the projectile seat piston.

* * * * *